US008205936B2

(12) United States Patent
Alessandro

(10) Patent No.: US 8,205,936 B2
(45) Date of Patent: Jun. 26, 2012

(54) CHAIR CONVERTIBLE INTO A CHAISE-LOUNGE

(75) Inventor: Piretti Alessandro, Bologna (IT)

(73) Assignee: Pro-Cord S.p.A., Bologna (IT)

( * ) Notice: Subject to any disclaimer, the term of this patent is extended or adjusted under 35 U.S.C. 154(b) by 149 days.

(21) Appl. No.: 12/694,611

(22) Filed: Jan. 27, 2010

(65) Prior Publication Data

US 2010/0187890 A1 Jul. 29, 2010

(30) Foreign Application Priority Data

Jan. 27, 2009 (EP) ..... 09425019

(51) Int. Cl.
*A47C 13/00* (2006.01)
*A47C 7/50* (2006.01)

(52) U.S. Cl. ..... 297/118; 297/423.2; 297/423.21; 297/423.22; 297/423.23; 297/423.24; 297/423.37; 5/619

(58) Field of Classification Search ..... 297/118, 297/423.2, 423.21, 423.22, 423.23, 423.24, 297/423.37; 5/619
See application file for complete search history.

(56) References Cited

U.S. PATENT DOCUMENTS

| | | | | | |
|---|---|---|---|---|---|
| 252,169 | A | | 1/1882 | Archer | |
| 376,256 | A | * | 1/1888 | Parks | 297/423.2 X |
| 439,088 | A | * | 10/1890 | Allen | 297/423.32 X |
| 834,376 | A | * | 10/1906 | Flindall | 297/423.2 X |
| 1,262,216 | A | * | 4/1918 | Lee | 297/423.24 |
| 1,911,116 | A | * | 5/1933 | Guttin | 297/118 X |
| 3,007,738 | A | * | 11/1961 | Gardel et al. | 297/423.2 |
| 3,046,050 | A | * | 7/1962 | Fowler | 297/118 |
| 3,137,528 | A | | 6/1964 | Bottemiller | |
| 3,227,439 | A | * | 1/1966 | Carlson | 5/618 |
| 3,318,596 | A | * | 5/1967 | Herzog | 5/619 |
| 4,373,222 | A | * | 2/1983 | Wolfe et al. | 5/657 |
| 4,940,286 | A | * | 7/1990 | Nguti | 297/423.37 |

(Continued)

FOREIGN PATENT DOCUMENTS

BE 355 819 11/1928

(Continued)

OTHER PUBLICATIONS

European Search Report issued Jul. 6, 2010 in connection with EP App No. 09171577.1.

*Primary Examiner* — Rodney B White
(74) *Attorney, Agent, or Firm* — Nixon & Vanderhye P.C.

(57) ABSTRACT

A chair convertible into a chaise lounge comprises: a stationary base structure having a front section and a rear section, a sitting unit including a seat portion and a backrest portion, wherein the seat portion is inclined with respect to a horizontal plane; and two foot-rests, each of which has a portion for resting the feet and a portion for resting on the floor. Each of the foot-rests is articulated to the front section of the base structure about a respective vertical axis of articulation and is rotatable substantially through 180° between an inoperative position and an operative position. In the inoperative position, each portion for resting the feet extends underneath the seat portion of the sitting unit, and in the operative position each portion for resting the feet extends forward beyond a front edge of the seat portion and has an inclination with respect to a horizontal plane opposite with respect to the inclination of the seat portion.

7 Claims, 11 Drawing Sheets

U.S. PATENT DOCUMENTS

| | | | | |
|---|---|---|---|---|
| 5,120,071 | A * | 6/1992 | Thibault et al. | 297/423.21 X |
| 5,927,812 | A | 7/1999 | Vanderminden, Sr. | |
| 6,101,652 | A * | 8/2000 | Matern, Jr. | 5/648 |
| 6,202,230 | B1 * | 3/2001 | Borders | 5/619 X |
| 6,378,149 | B1 * | 4/2002 | Sanders et al. | 5/619 X |
| 6,446,287 | B2 * | 9/2002 | Borders | 5/619 X |
| 7,387,332 | B2 * | 6/2008 | Piretti | 297/118 X |
| 7,454,806 | B2 * | 11/2008 | Koch et al. | 5/624 |
| 7,896,442 | B2 * | 3/2011 | White | 297/423.37 |
| 2004/0133979 | A1 * | 7/2004 | Newkirk et al. | 5/600 |
| 2009/0127892 | A1 * | 5/2009 | Chen | 297/118 |

FOREIGN PATENT DOCUMENTS

| | | | | |
|---|---|---|---|---|
| DE | 94 00 625 | | 3/1994 | |
| EP | 534908 | A1 * | 3/1993 | 297/423.22 |

* cited by examiner

CHAIR CONVERTIBLE INTO A CHAISE-LOUNGE

This application claims priority to European Application No. 09425019.8, filed 27 Jan. 2009, the entire contents of which is hereby incorporated by reference.

BACKGROUND OF THE INVENTION

The present invention relates to a chair convertible into a chaise-lounge. A chaise-lounge is traditionally made up of three portions with different inclinations: a backrest portion, a seat portion and a foot-rest portion. The seat portion and the foot-rest portion usually have inclinations opposite to one another with respect to a horizontal plane so that, when the user is sitting on a chaise-lounge, his knees are usually at a greater height than his pelvis and feet.

DESCRIPTION OF THE KNOWN ART

The document U.S. Pat. No. 3,137,528 describes a chair convertible into a chaise-lounge, which includes a foot-rest that can be removed. This solution presents the drawback that removal of the foot-rest is a complex and problematical operation, which entails the need to dismantle the components by acting in the bottom part of the chair.

Chairs with foot-rest are moreover described in the documents DE-U-9400625 and U.S. Pat. No. 252,169. These documents do not describe chairs convertible into chaises-lounges and does not describe simple systems for setting the foot-rest in an inoperative position.

SUMMARY OF THE INVENTION

The object of the present invention is to provide a chair that can be converted into a chaise-lounge, and vice versa, with simple and fast operations.

According to the present invention, this object is achieved by a chair having the characteristics forming the subject of Claim 1.

BRIEF DESCRIPTION OF THE DRAWINGS

The present invention will now be now described in detail with reference to the attached drawings, which are provided purely by way of non-limiting example and in which.

DESCRIPTION OF THE PREFERRED EMBODIMENT

Figure 1:
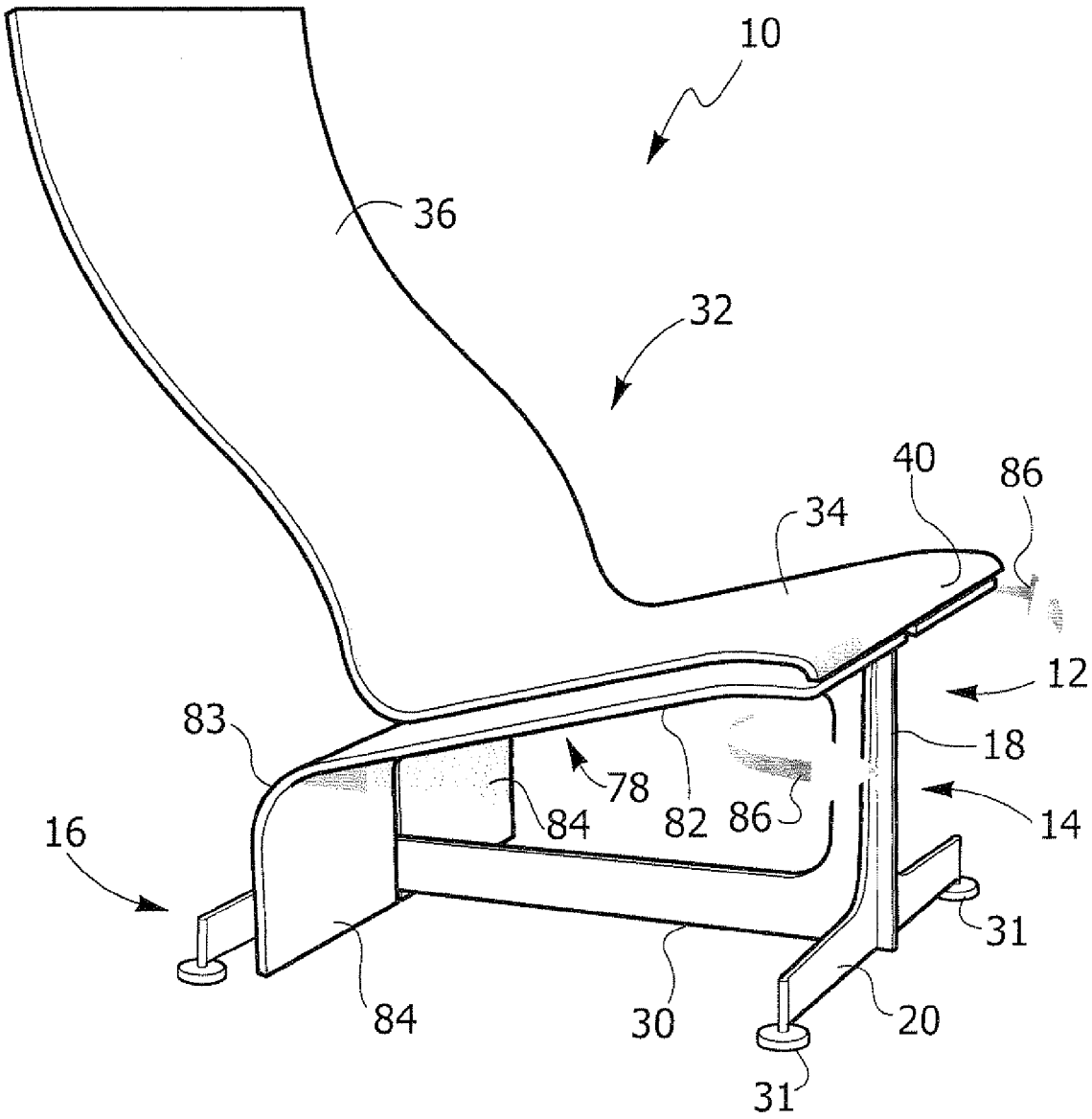
FIG. 1 is a perspective view of a chair convertible into a chaise-lounge according to the present invention in the chair configuration.
Figure 2:
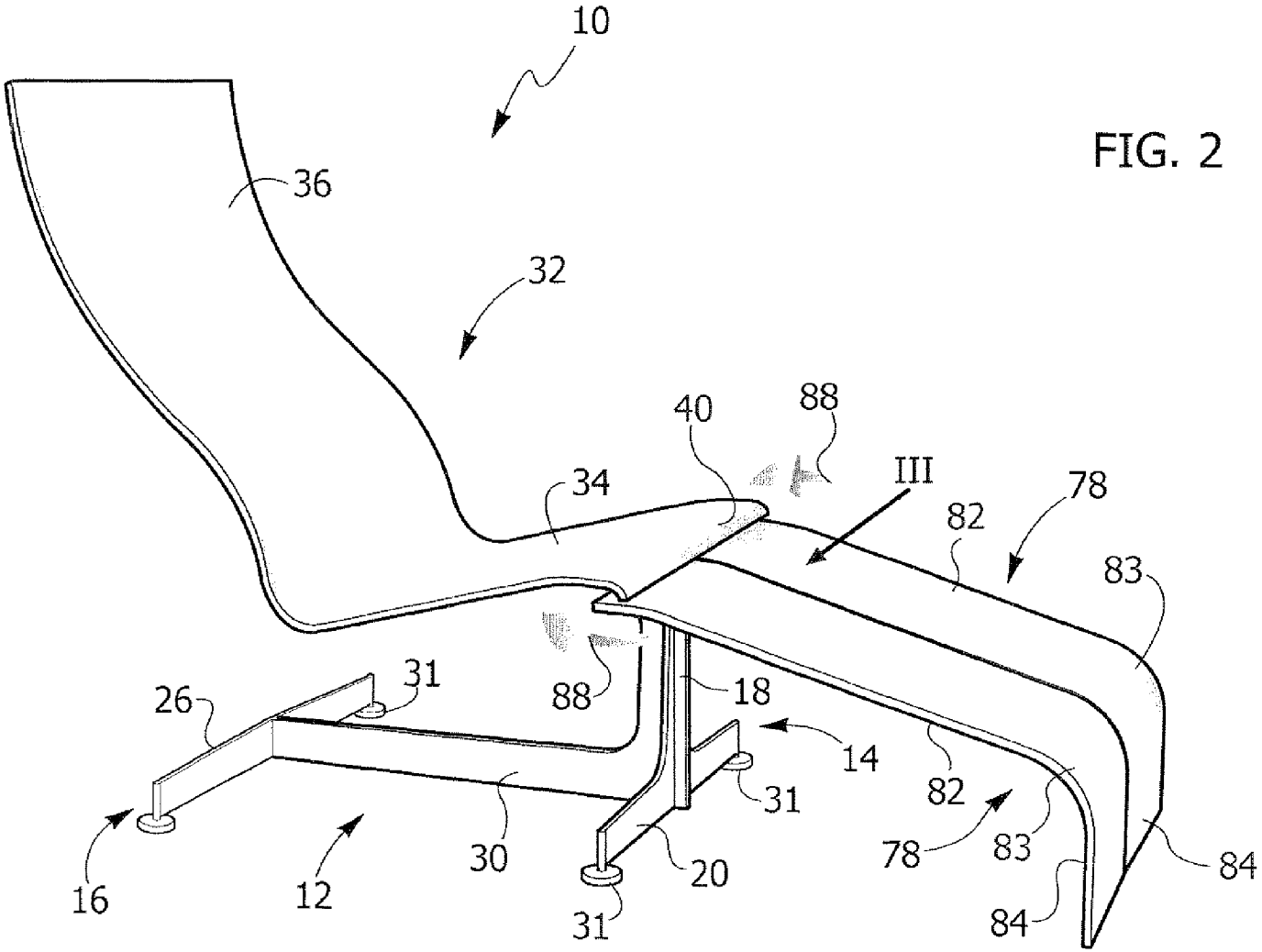
FIG. 2 is a perspective view of the chair of FIG. 1 in the chaise-lounge configuration.
Figure 3:
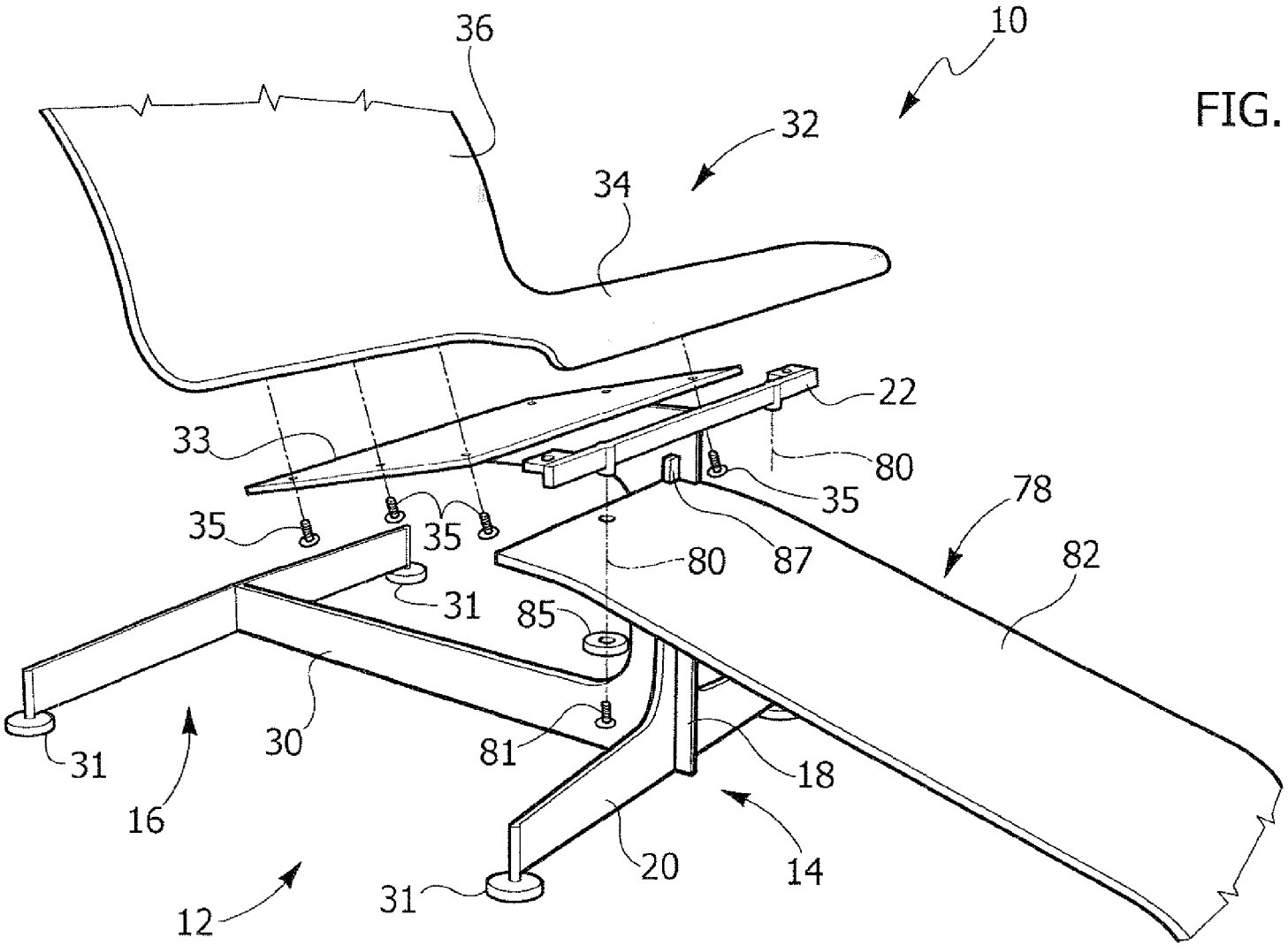
FIG. 3 is a partial and exploded perspective view of the part indicated by the arrow III in FIG. 2.
Figure 4:
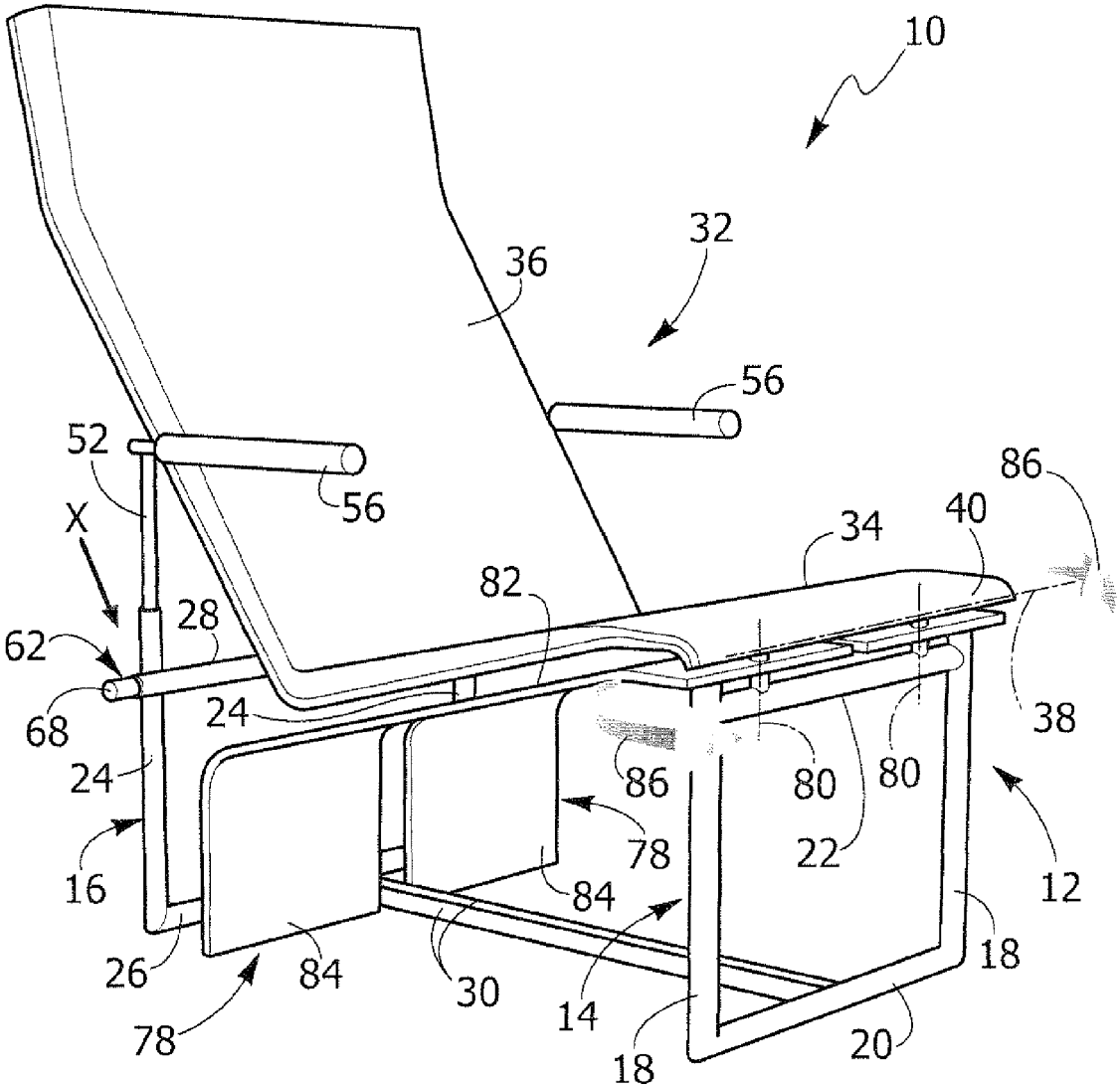
FIG. 4 is a perspective view of a second embodiment of a chair according to the present invention.

With reference to FIGS. 1 to 3, designated by 10 is a chair convertible into a chaise-lounge according to the present invention. The chair 10 comprises a stationary base structure 12 having a front section 14 and a rear section 16. In the embodiment illustrated, the front section 14 has a central vertical element 18 fixed at its ends to a bottom transverse element 20 and a top transverse element 22. The rear section 16 has a bottom transverse element 26. The front section 14 and the rear section 16 are joined to one another by means of a longitudinal element 30. The base structure 12 rests on the floor by means of feet 31 set at the ends of the bottom transverse elements 20, 26.

The embodiment described above of the base structure 12 is not, however, mandatory and may be varied according to considerations of a styling nature.

The chair 10 comprises a sitting unit 32 formed by a seat portion 34 and by a backrest portion 36. In the example illustrated in FIGS. 1-3, the seat portion 34 and the backrest portion 36 are fixed with respect to one another and form part of a single moulded body. The sitting unit could be equipped with armrests that could be integrated with the sitting unit or assembled thereto.

The sitting unit 32 could be provided in many other ways. For example, the seat portion 34 and the backrest portion 36 could be made of two separate pieces connected to one another by means of a frame portion or else by means of lateral connection elements that function also as armrests.

With reference to FIG. 3, the base structure 12 comprises a plate 33 fixed to the top end of the central vertical element 18. The seat portion 34 of the sitting unit 32 is fixed to the plate 33 for example by means of screws 35 and has a front edge 40 adjacent to the top transverse element 22.

The chair 10 comprises two foot-rests 78, each of which comprises a portion for resting the feet 82. Each foot-rest 78 can, for example, be formed by a shaped rigid panel.

Preferably, each foot-rest 78 comprises a portion for resting on the floor 84. Preferably, each portion for resting on the floor 84 is inclined with respect to the respective portion for resting the feet 82, and an arched portion 83 extends between the portion for resting the feet 82 and the portion for resting on the floor 84. In the example illustrated, each portion for resting on the floor 84 extends in a vertical or substantially vertical plane. The foot-rests 78 could be without the portion for resting on the floor and the corresponding connection portion. In this case, the portion for resting the feet 82 would be raised from the floor.

Each foot-rest 78 is rotatable with respect to the stationary base structure 12 about a respective vertical axis 80 between an inoperative position, illustrated in FIG. 1, and an operative position, illustrated in FIG. 2. As is illustrated in FIG. 3, each foot-rest 78 is rotatable about a respective articulation pin 81 fixed to the top transverse element 22. Each articulation pin 81 defines a respective axis 80. Preferably, a washer 85 is set between the head of the pin 81 and the bottom surface of the foot-rests 78.

Each foot-rest 78 can rotate about the respective vertical axis 80 substantially through 180° to pass from the inoperative position to the operative position, and vice versa. Each foot-rest 78 has an arrest projection 87 eccentric with respect to the axis 80. The arrest projection 87 bears upon the top transverse element 22 to define the inoperative and operative positions of the foot-rest 78.

Rotation of the foot-rests 78 is carried out manually by the user. The arrows 86 in FIG. 1 show the direction of rotation of the foot-rests 78 to pass from the inoperative position to the operative position. The arrows 88 in FIG. 2 show the direction of rotation of the foot-rests 78 to pass from the operative position to the inoperative position.

FIG. 1 illustrates the convertible chair 10 according to the present invention in use as a chair. In this configuration, the foot-rests 78 extend underneath the seat portion 34 of the sitting unit 32. The portions for resting the feet 82 are substantially parallel to the seat portion 34.

FIG. 2 illustrates the convertible chair, according to the present invention, in the chaise-lounge configuration. In this configuration, the foot-rests 78 extend forwards beyond the front edge 40 of the seat portion 34. It may be noted that the seat portion 34 and the portions for resting the feet 82 are inclined with respect to a horizontal plane in mutually opposite directions. When the user is sitting on the chair in the chaise-lounge configuration, his knees are set in a position corresponding to the front edge 40 of the seat portion 34 and are in a raised position with respect to the pelvis and to the feet, according to the position typical of a chaise-lounge. The bottom ends of the portions for resting on the floor 84 rest on the floor both in the inoperative position and in the operative position.

FIGS. 4 to 11 illustrate a second embodiment of the chair according to the present invention. The elements corresponding to the ones described previously are designated by the same reference numbers.

In this second embodiment, the sitting unit 32 is articulated to the front section 14 of the base structure 12 about a horizontal axis 38 located in a position corresponding to the front edge 40 of the seat portion 34.

Figure 9:
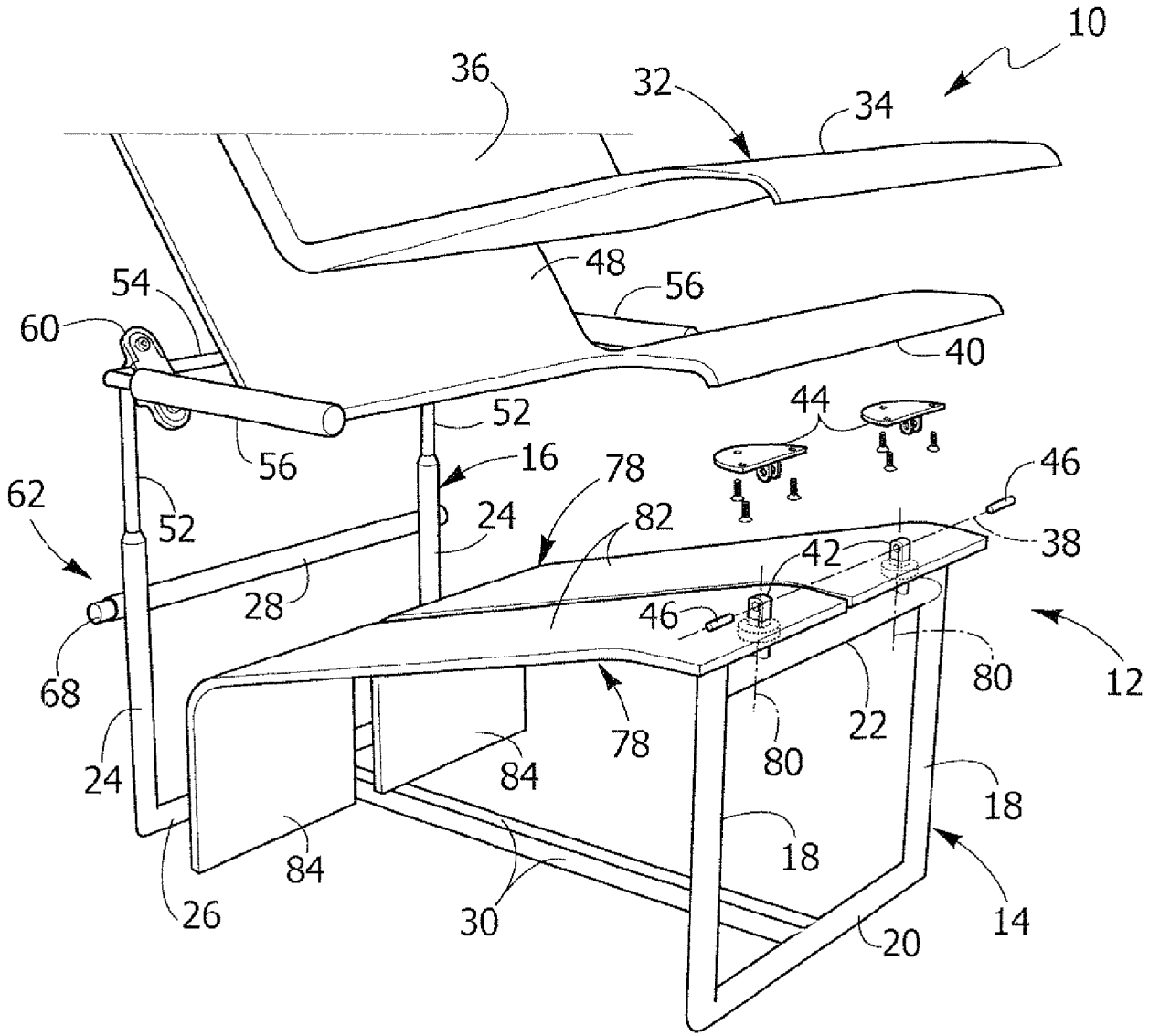
FIG. 9 is a partial and exploded perspective view of the part indicated by the arrow IX in FIG. 4.

The articulation between the sitting unit 32 and the front section 14 of the base structure 12 is preferably made as illustrated in FIG. 9. The axis of articulation 38 is defined by aligned holes for two pins 42 fixed to the top transverse element 22 of the front section 14. The sitting unit 32 is articulated to the pins 42 by means of two brackets 44 fixed on the bottom surface of the seat portion 34, at its front edge 40. The brackets 44 are articulated to the pins 42 by means of transverse pins 46 sharing the axis of articulation 38. As is illustrated in FIG. 9, the sitting unit 32 can be formed by a rigid panel 48, on which a padding 50 is applied.

As illustrated in FIG. 9, the foot-rests 78 are preferably mounted rotatable around the same pins 42 that carry the horizontal axis of articulation 38 of the sitting unit 32. The axes of rotation 80 of the foot-rests 78 coincide with the axes of the pins 42 and intersect the horizontal axis of articulation 38.

The rear part of the sitting unit 32 is connected in a vertically mobile way to the rear section 16 of the base structure 12. The rear section 16 has two vertical elements 24 of a tubular shape that form two guides with vertical axis. Two mobile rods 52 are slidably engaged within the vertical elements 24. The mobile rods 52 are connected to one another by means of a transverse rod 54. The side ends of the transverse rod 54 are bent forwards and bear respective armrests 56.

Figure 6:
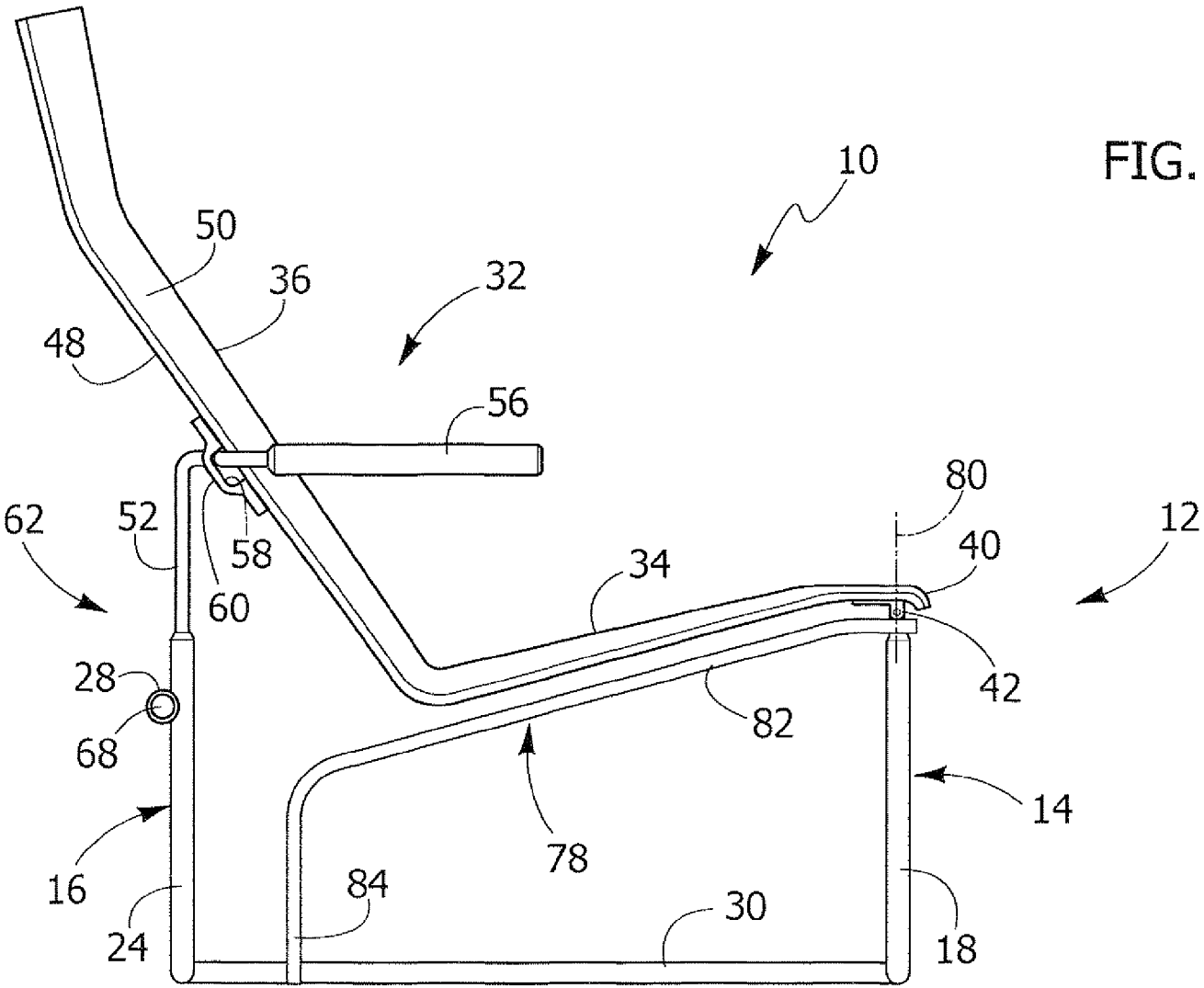
FIGS. 6 and 7 are side views corresponding respectively to those of FIGS. 4 and 5.
Figure 7:
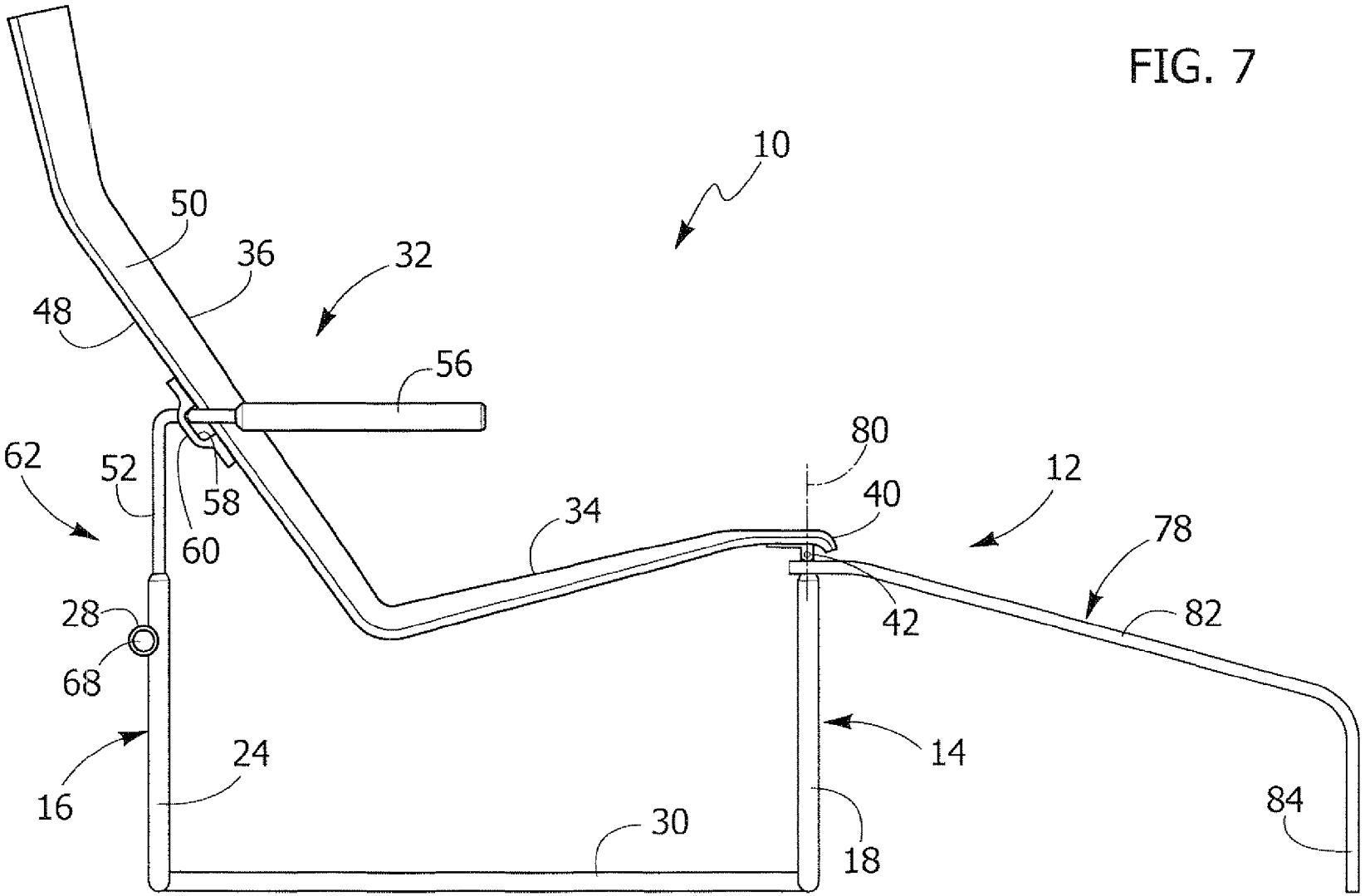
Figure 8:
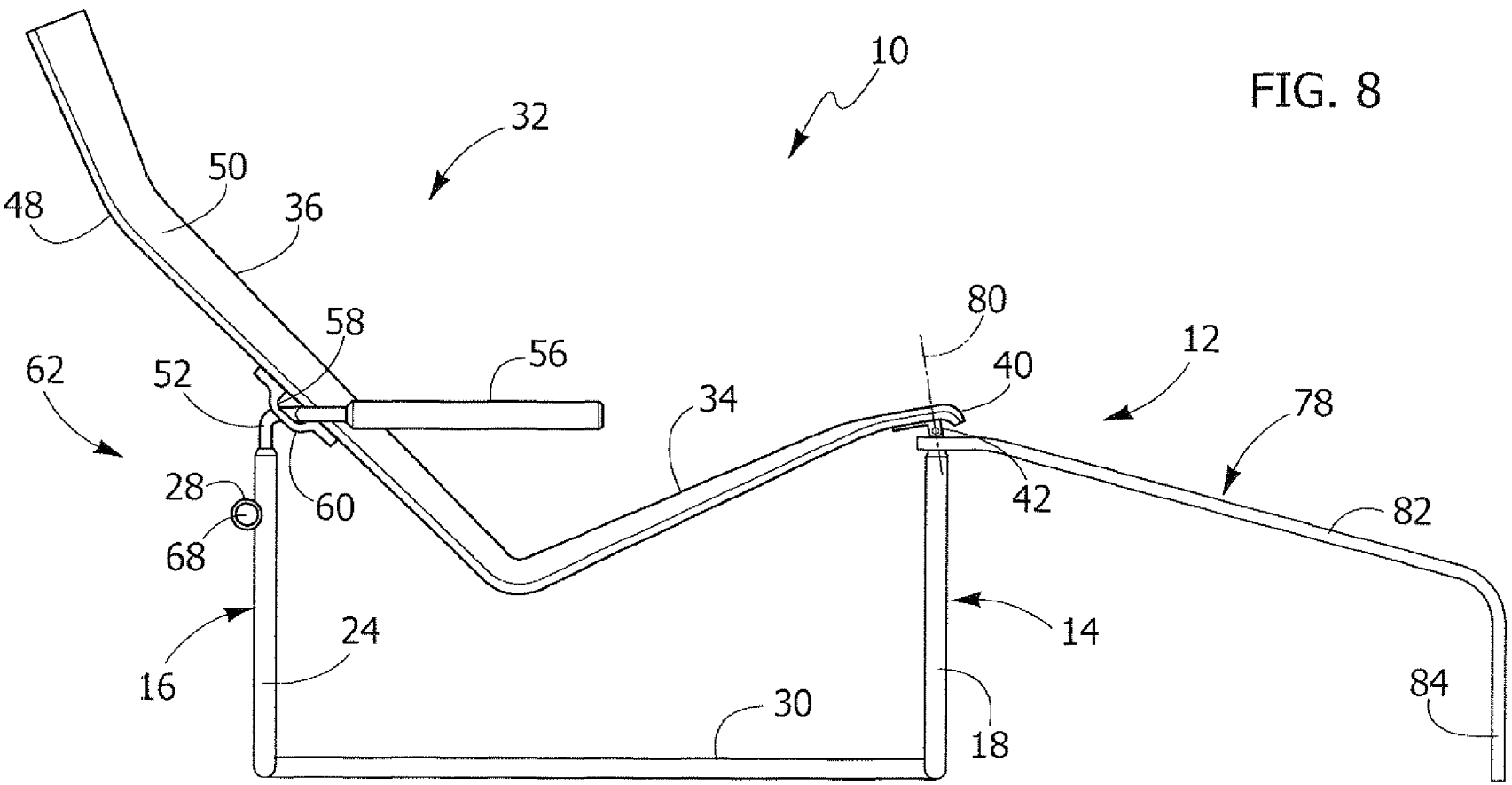
FIG. 8 is a side view of the chair of FIG. 4 in the chaise-lounge configuration with the sitting unit in a position inclined backwards.

With reference to FIGS. 6 to 8, the transverse rod 54 engages in a mobile way two elongated slots 58 formed in respective brackets 60 fixed to the rear wall of the backrest portion 36 of the sitting unit 32. In one variant (not illustrated), each pair constituted by the bracket 60 and by the slot 58 may be replaced by a joint made of elastic material, such as, for example, rubber or the like. Said joint connects the transverse rod 54 to the rear surface of the panel 48. The elasticity of the material enables a joint to be obtained with functional characteristics identical to those of the solution already described but visibly more essential and elegant.

Figure 10:
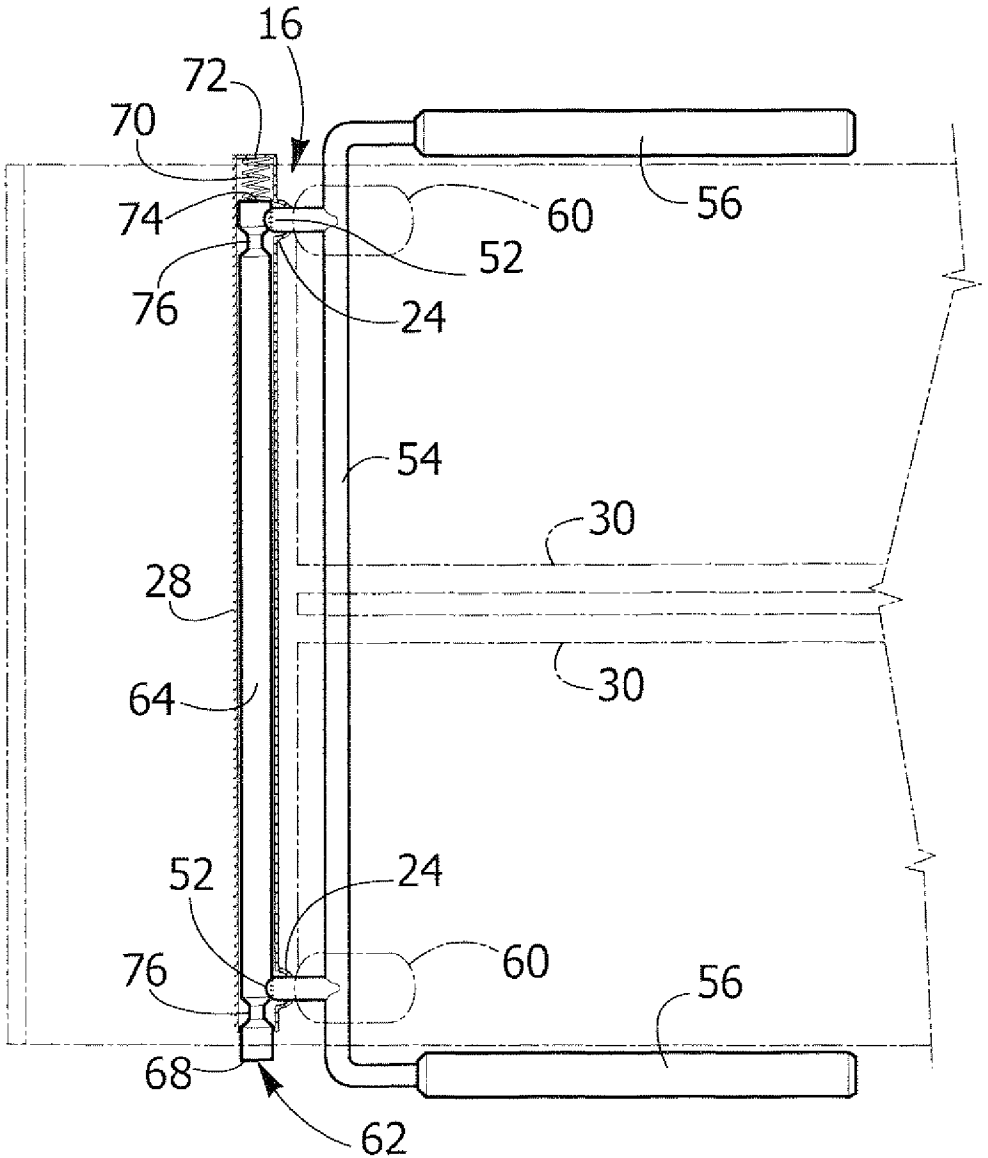
FIG. 10 is a partially sectioned plan view of a clamping device indicated by the arrow X in FIG. 4.
Figure 11:
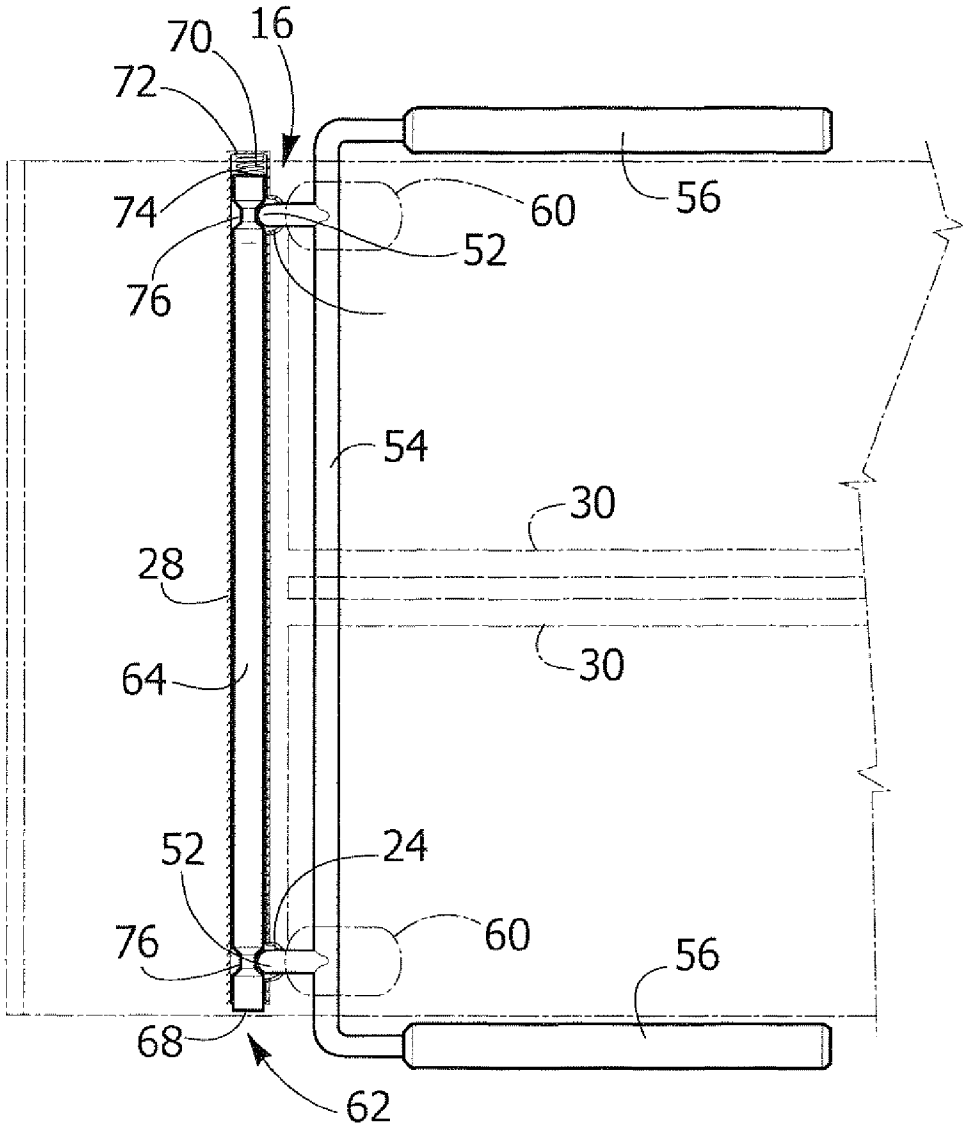
FIG. 11 is a view corresponding to that of FIG. 7, which illustrates the clamping device in a position of disengagement.

A clamping device 62 is set in the rear section 16 of the base structure 12. With reference in particular to FIGS. 10 and 11, the clamping device 62 comprises a clamping bar 64 axially mobile within the top cross member 28 of the rear section 16. The clamping bar 64 has a first end 68 that projects on the outside of the top cross member 28. An elastic element 70 acts between a closed end 72 of the transverse element 28 and a second end 74 of the clamping bar 64. The elastic element 70 tends to push the clamping bar 64 towards the outside of the top cross member 28. The clamping bar is equipped with a transverse pin (not visible in the drawings), which engages a longitudinal slot (not visible in the drawings either) of the top cross member 28. The pin-slot coupling limits the travel of the bar 64, preventing this from being expelled from the top cross member 28 by the thrust received from the elastic element 70.

The clamping bar 64 has two portions of reduced diameter 76 situated in the vicinity of the ends 68, 74. The top cross member 28 intersects the vertical elements 24 partially. When the elastic element 70 is in the extended position (FIG. 10), the clamping bar 64 has two stretches adjacent to the portions of reduced diameter 76 that extend partially within the vertical elements 24. When the elastic element 70 is in the compressed position (FIG. 11), the portions of reduced diameter 76 of the clamping bar 64 are positioned in the areas of intersection between the top cross member 28 and the vertical elements 24.

Each mobile rod 52 is equipped with at least one arrest notch (not visible in the drawings) with a shape complementary to the outer surface of the clamping bar 64. In the position illustrated in FIG. 10, the arrest notches of the mobile rods 52 couple with the portions of the clamping bar 64 that extend within the vertical elements 24. In this condition, the mobile rods 52 are clamped with respect to the rear section 16 of the base structure 12. By pressing axially on the ends 68 of the clamping bar 64, the portions of reduced diameter 76 of the clamping bar 64 move into a position corresponding to the vertical tubular elements 24 (configuration of FIG. 11). In this condition, the mobile rods 52 are free to move vertically within the vertical elements 24. On the mobile rods 52 there may be provided a plurality of arrest notches, staggered with respect to one another in a vertical direction, to each of which there corresponds a position of clamping of the sitting unit 32 with respect to the stationary base structure 12.

Figure 5:
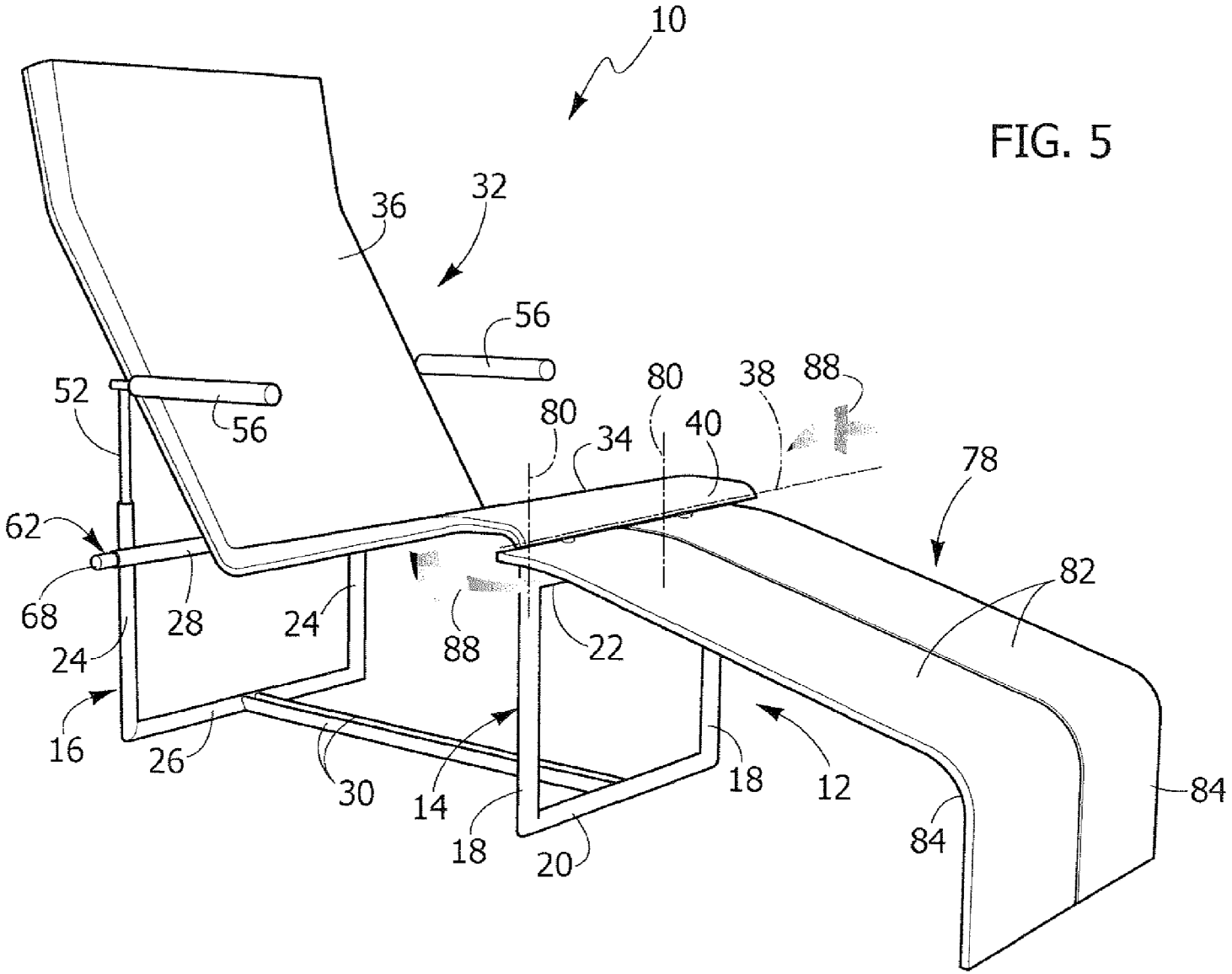
FIG. 5 is a perspective view of the chair of FIG. 4 in the chaise-lounge configuration.

In the chaise-lounge configuration, it is possible to vary the inclination backwards of the sitting unit 32. FIGS. 7 and 8 illustrate the sitting unit 32 in a raised position and in a position reclined backwards, respectively. In the configuration of FIG. 7, the sitting unit 32 is kept in the raised position by the clamping device 62. To recline the sitting unit 32 backwards, the clamping device 62 is disengaged by pressing on the end 68 of the clamping bar 64. After disengaging the clamping device 62, it is possible to slide the vertically mobile rods 52 downwards, thus bringing the sitting unit 32 into the position where it is reclined backwards, as illustrated in FIG. 5. As mentioned previously, it is possible to provide a plurality of positions with different inclinations by forming on the mobile rods 52 a plurality of arrest notches staggered with respect to one another in a vertical direction.

The invention claimed is:

1. A chair convertible into a chaise lounge, comprising:

a stationary base structure having a front section and a rear section;

a sitting unit including a seat portion and a backrest portion, in which the seat portion is inclined with respect to a horizontal plane; and two foot-rests each of which has a portion for resting the feet, in which each of said foot-rests is articulated to the front section of the base structure about a respective vertical axis of articulation and is rotatable substantially through 180° between an inoperative position and an operative position, wherein in the inoperative position each portion for resting the feet extends underneath said seat portion of the sitting unit and wherein in the operative position each portion for resting the feet extends forward beyond a front edge of the seat portion and has an inclination with respect to a horizontal plane opposite with respect to the inclination of the seat portion, and wherein the sitting unit is articulated to the front section of the stationary base structure about a horizontal axis of articulation adjacent to said front edge of the seat portion, wherein the vertical axis of articulation of each of said foot-rests intersects the horizontal axis of articulation of the sitting unit.

2. The chair according to claim 1, wherein the front section of the stationary base structure comprises a transverse element to which are fixed two vertical pins that define said axes of articulation of said foot-rests and moreover carry said horizontal axis of articulation of the sitting unit.

3. The chair according to claim 1, wherein the rear section of the base structure comprises two vertical tubular elements, in which are engaged respective vertically mobile rods associated to the sitting unit and co-operating with a clamping device.

4. The chair according to claim 3, wherein said vertically mobile rods are connected to one another by means of a transverse rod having side ends that engage a slot fixed with respect to the backrest portion of the sitting unit.

5. The chair according to claim 3, wherein said transverse rod carries at its side ends two armrests.

6. The chair according to claim 3, wherein said clamping device comprises a clamping bar mobile within a transverse tubular element fixed to said vertical elements of the rear section.

7. The chair according to claim 6, wherein said clamping bar co-operates with an elastic element and is mobile axially between a clamping position and a releasing position, in which each of said vertically mobile rods has at least one arrest notch that is to co-operate with said arrest bar.

* * * * *